US007950598B2

(12) United States Patent
Olson et al.

(10) Patent No.: US 7,950,598 B2
(45) Date of Patent: May 31, 2011

(54) INTEGRATED FLOW CONTROL ASSEMBLY FOR AIR-ASSISTED SPRAY GUN

(75) Inventors: Diane L. Olson, Princeton, MN (US); Daniel R. Johnson, Blaine, MN (US); Pamela J. Muetzel, Otsego, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 200 days.

(21) Appl. No.: 12/346,579

(22) Filed: Dec. 30, 2008

(65) Prior Publication Data

US 2010/0163648 A1 Jul. 1, 2010

(51) Int. Cl.
*A62C 13/62* (2006.01)

(52) U.S. Cl. ..... 239/340; 239/331; 239/569

(58) Field of Classification Search ..... 239/407, 239/368, 581.1, 569, 398, 409, 413, 141, 239/303, 308, 311, 340
See application file for complete search history.

(56) References Cited

U.S. PATENT DOCUMENTS

| | | | | |
|---|---|---|---|---|
| 2,485,723 | A * | 10/1949 | Fitzgerald | 169/14 |
| 3,107,858 | A | 10/1963 | Ganzel et al. | |
| 3,327,949 | A | 6/1967 | Eull | |
| 3,653,592 | A | 4/1972 | Cowan | |
| 3,873,023 | A | 3/1975 | Moss et al. | |
| 4,174,070 | A | 11/1979 | Lau et al. | |
| 4,216,907 | A | 8/1980 | Fuller | |
| 4,513,777 | A | 4/1985 | Wright | |
| 4,754,923 | A | 7/1988 | Matusita et al. | |
| 4,766,927 | A | 8/1988 | Conatser | |
| 4,925,101 | A | 5/1990 | Konieczynski et al. | |
| 4,934,602 | A | 6/1990 | Mattson | |
| 5,054,687 | A | 10/1991 | Burns et al. | |
| 5,067,518 | A | 11/1991 | Kosmyna | |
| 5,080,285 | A | 1/1992 | Toth | |
| 5,119,992 | A | 6/1992 | Grime | |
| 5,141,161 | A | 8/1992 | Anderson et al. | |
| 5,190,219 | A | 3/1993 | Copp, Jr. | |
| 5,218,993 | A | 6/1993 | Steinberg et al. | |

(Continued)

FOREIGN PATENT DOCUMENTS

JP 2001129444 A 5/2001

(Continued)

OTHER PUBLICATIONS

The Search Report and Written Opinion of the International Searching Authority in counterpart Application No. PCT/US2009/006682 filed Dec. 22, 2009.

(Continued)

*Primary Examiner* — Davis Hwu
(74) *Attorney, Agent, or Firm* — Kinney & Lange, P.A.

(57) ABSTRACT

An air-assisted sprayer comprises a platform, an air reservoir, a fluid reservoir, a spray cap and a dual flow valve. The air reservoir extends through the platform and is configured to receive a source of pressurized air. The fluid reservoir extends through the platform to intersect the air reservoir, and is configured to receive a source of pressurized fluid. The spray cap is configured to receive pressurized air from the air reservoir and pressurized fluid from the fluid reservoir to discharge a stream of atomized fluid from the platform. The dual flow valve is positioned within the platform to intersect the air reservoir and the fluid reservoir to simultaneously vary volumetric flow rates of the pressurized air and the pressurized fluid over a range.

16 Claims, 6 Drawing Sheets

U.S. PATENT DOCUMENTS

| | | | | |
|---|---|---|---|---|
| 5,226,600 | A | 7/1993 | Frank | |
| 5,236,128 | A | 8/1993 | Morita et al. | |
| 5,284,299 | A | 2/1994 | Medlock | |
| 5,322,221 | A | 6/1994 | Anderson | |
| 5,330,108 | A | 7/1994 | Grime et al. | |
| 5,460,203 | A | 10/1995 | Smith et al. | |
| 5,529,460 | A | 6/1996 | Eihusen et al. | |
| 5,711,485 | A | 1/1998 | Wheeler | |
| 6,019,293 | A | 2/2000 | Sweazy et al. | |
| 6,019,294 | A | 2/2000 | Anderson et al. | |
| 6,036,114 | A | 3/2000 | Shih | |
| 6,708,900 | B1 | 3/2004 | Zhu et al. | |
| 6,779,742 | B2 * | 8/2004 | Kitajima | 239/290 |
| 6,877,681 | B2 | 4/2005 | Hartle et al. | |
| 6,955,724 | B2 | 10/2005 | Dankert | |
| 7,118,049 | B2 * | 10/2006 | Dodd | 239/318 |
| 2007/0164129 | A1 | 7/2007 | Doner et al. | |
| 2007/0267523 | A1 | 11/2007 | Roumanis | |

FOREIGN PATENT DOCUMENTS

| | | | |
|---|---|---|---|
| JP | 2008012404 | A | 1/2008 |

OTHER PUBLICATIONS

Graco Inc. Fine Finish Solutions product brochure.
Graco Inc. Instructions-Parts List for HVLP—Turbine Gun.

* cited by examiner

INTEGRATED FLOW CONTROL ASSEMBLY FOR AIR-ASSISTED SPRAY GUN

CROSS-REFERENCE TO RELATED APPLICATION(S)

The present application is related to the following co-pending applications filed on the same day as this application: "POPPET CHECK VALVE FOR AIR-ASSISTED SPRAY GUN" by inventors D. Johnson, G. Davidson, E. Finstad and P. Muetzel (U.S. patent application Ser. No. 12/346,593.

BACKGROUND

The present invention relates to spray guns for applying coatings, and, in particular to air controls for high volume, low pressure (HVLP) spray guns. HVLP guns are commonly used to apply finish coats to painted or varnished products. As such, it is desirable that the coating be applied in an even and consistent manner. HVLP guns use air supplied by an external turbine to apply a fluid coating that hardens into a finish. Specifically, the HVLP gun is provided with a container for storing the fluid coating, while the external turbine supplies pressurized air to the gun to pressurize the container and to provide an atomization air jet in which the pressurized fluid is sprayed. The most aesthetically pleasing finishes are achieved when the volume of air flowing through the gun optimally vaporizes the fluid leaving the gun, thereby avoiding blotting or clustering of the sprayed fluid. Typically, HVLP guns are outfitted with multiple valves to control air and fluid flow through the gun. For example, a trigger-operated fluid valve is typically provided to vary the volume of fluid flowing through the gun. A separate on/off air valve is connected to the trigger to permit a fixed volume of air through the gun. Thus, a separate knob-operated valve must be provided to vary the volume of air flowing through the gun. Thus, an operator must adjust both the trigger and knob to obtain optimal vaporization of the sprayed finish coating. It is desirable to reduce the complexity of operating HVLP guns such that their use is more widely available to less skilled operators.

SUMMARY

The present invention is directed to an air-assisted sprayer comprising a platform, an air reservoir, a fluid reservoir, a spray cap and a dual flow valve. The air reservoir extends through the platform and is configured to receive a source of pressurized air. The fluid reservoir extends through the platform to intersect the air reservoir, and is configured to receive a source of pressurized fluid. The spray cap is configured to receive pressurized air from the air reservoir and pressurized fluid from the fluid reservoir to discharge a stream of atomized fluid from the platform. The dual flow valve is positioned within the platform to intersect the air reservoir and the fluid reservoir to simultaneously vary volumetric flow rates of the pressurized air and the pressurized fluid over a range.

DETAILED DESCRIPTION

Figure 1:
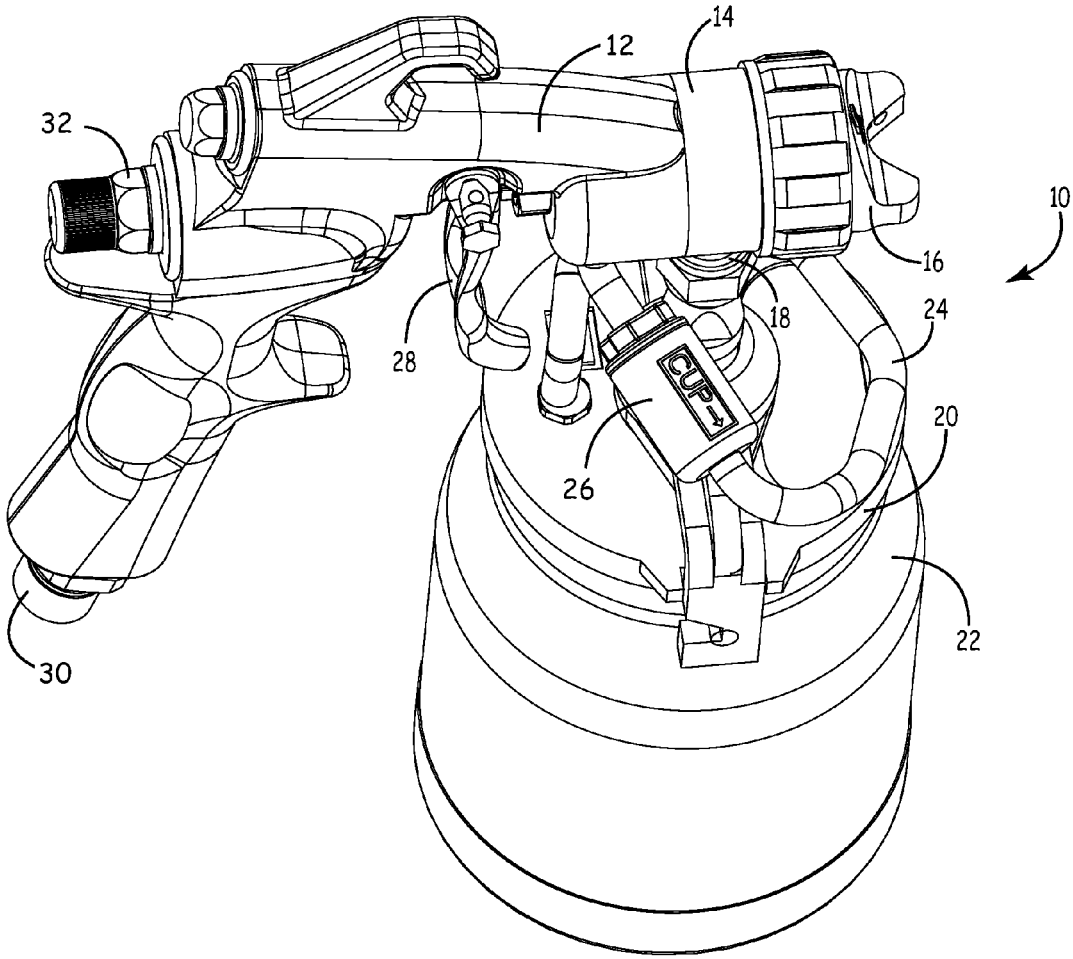
FIG. 1 shows a perspective view of an air-assisted spray gun having an integrated flow control assembly of the present invention.

FIG. 1 shows a perspective view of air-assisted spray gun 10 having an integrated flow control assembly of the present invention. In the embodiment shown, air-assisted spray gun 10 comprises a high volume, low pressure (HVLP) spray gun. Spray gun 10 includes platform 12, nozzle housing 14, spray cap 16, fluid coupling 18, fluid lid assembly 20, fluid cup 22, pressure line 24, check valve 26, trigger 28, air coupling 30 and trigger lock 32. During operation, fluid cup 22 is provided with a fluid that is desired to be sprayed from spray gun 10. For example, fluid cup 22 is filled with a paint or varnish that is fed to nozzle housing 14 through fluid lid assembly 20 and fluid coupling 18. Air coupling 30 is connected to a source of pressurized air. Typically, HVLP spray guns are connected to portable turbines that provide a high volume of air at a low pressure to coupling 30, such as through a hose. For example, a typical HVLP turbine is capable of providing approximately 58 cubic feet per minute (cfm) [~1642 liters per minute (lpm)] of air at 5 pounds per square inch (psi) [~34.5 kiloPascals (kPa)]. Pressurized air provided to air coupling 30 flows through an air reservoir within platform 12 to spray cap 16 and to pressure line 24. The pressurized air flows through pressure line 24, check valve 26 and fluid lid assembly 20 into fluid cup 22. The pressurized air forces fluid out of cup 22 and into fluid coupling 18 and into a fluid reservoir within nozzle housing 14. Check valve 26 prevents fluid in cup 22 from migrating back into the air reservoir within platform 12. Within nozzle housing 14, the forced fluid is discharged from a fluid nozzle and infused into the pressurized air within spray cap 16. The fluid becomes atomized and expelled from gun 10 through a discharge orifice disposed in cap 16. Trigger 28 is mounted to platform 12 to enable volumes of the pressurized air and fluid to be discharged from the discharge orifice. Trigger lock 32 restricts movement of trigger 28 such that gun 10 can be set to desired maximum discharge volumes. Trigger 28 engages the integrated flow control assembly disposed within platform 12 to variably adjust both the volume of the air and the volume of the fluid from zero to the set maximum.

Figure 2:
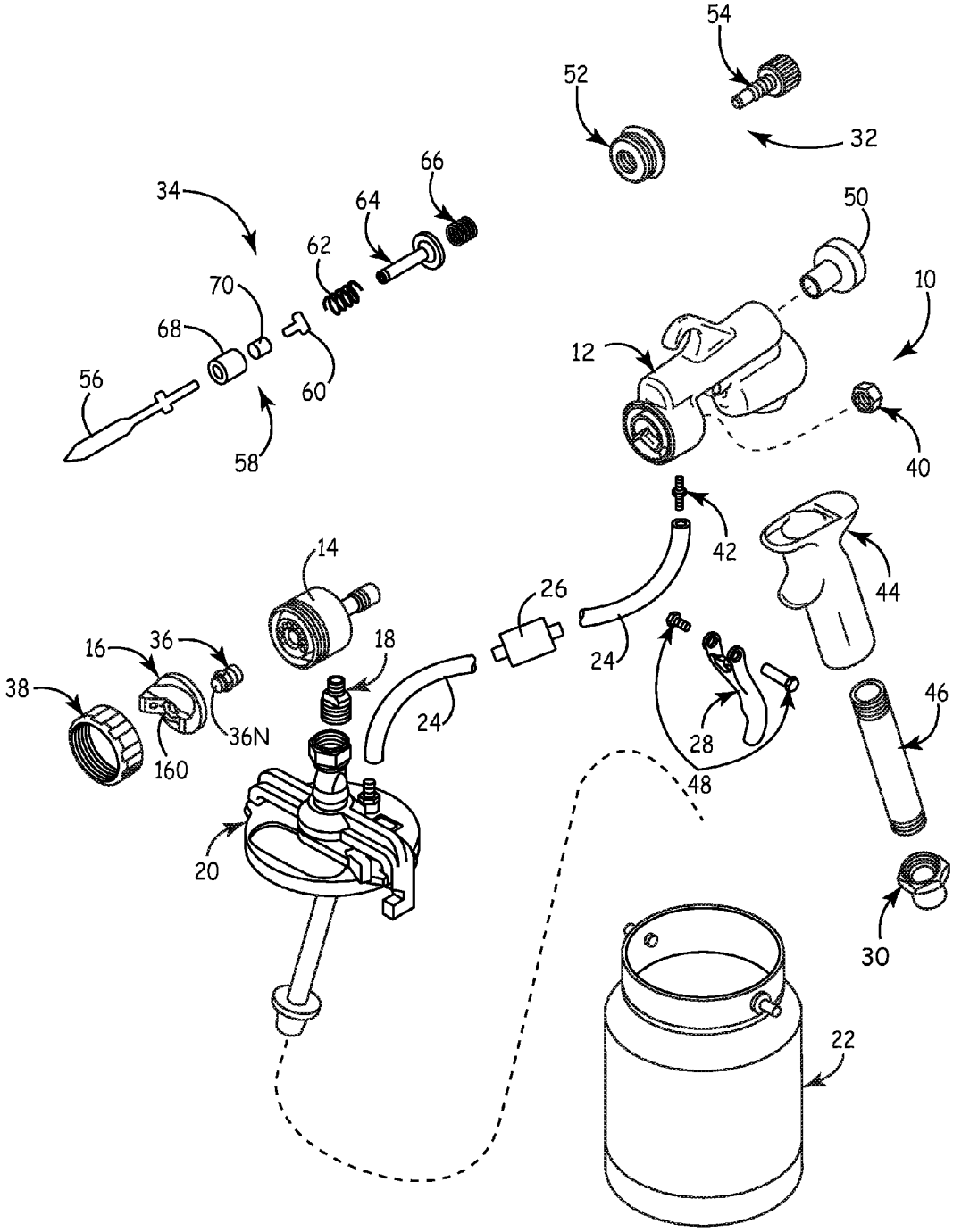
FIG. 2 shows an exploded view of the air-assisted spray gun of FIG. 1 showing a trigger lock and an integrated flow control assembly.

FIG. 2 shows an exploded view of spray gun 10 in which the major components are shown, including integrated flow control assembly 34. Spray gun 10 includes platform 12, nozzle housing 14, spray cap 16, fluid coupling 18, fluid lid assembly 20, fluid cup 22, pressure line 24, check valve 26, trigger 28, air coupling 30 and trigger lock 32, as shown in FIG. 1. Spray gun 10 also includes integrated flow control assembly 34, spray nozzle 36, retention ring 38, retention nut 40, air stem 42, handle 44, air tube 46, trigger pin assembly 48 and air cap 50. Trigger lock 32 includes retainer 52 and stop 54. Integrated flow control assembly 34 includes fluid valve 56, calibration mechanism 58, spacer 60, fluid spring 62, air valve 64 and air spring 66. Calibration mechanism 58 includes trigger ring 68 and calibration bushing 70.

Air coupling 30 is configured to connect to a source of pressurized air and a first end of air tube 46. Air tube 46 is inserted through handle 44, which connects to platform 12. A second end of air tube 46 connects to platform 12 to provide pressurized air to gun 10. Air cap 50 seals platform 12 such that pressurized air is prevented form escaping platform 12. Nozzle housing 14 and air stem 42 mount to platform 12 to receive pressurized air from air tube 46. Nozzle housing 14 inserts through a portion of platform 12 and is secured with retention nut 40, while air stem 42 threads into an opening in platform 12. Pressure line 24 fluidly connects air stem 42 with fluid lid assembly 20. Check valve 26 regulates air and fluid flow between cup 22 and platform 12. In one embodiment, check valve 26 comprises an in-line poppet valve, as is described in the related application entitled "POPPET CHECK VALVE FOR AIR-ASSISTED SPRAY GUN" by inventors D. Johnson, G. Davidson, E. Finstad and P. Muetzel, which is incorporated by this reference. Fluid lid assembly 20 is configured to pressurize cup 22 and force a fluid into coupling 18. Spray nozzle 36 connects to nozzle housing 14 to receive pressurized fluid from fluid coupling 18. Using retention ring 38, spray cap 16 connects to nozzle housing 14 to cover spray nozzle 36. Spray cap 16 includes discharge orifice 160 that receives pressurized air from nozzle housing 14 and pressurized fluid from fluid nozzle 36N of spray nozzle 36. Integrated flow control assembly 34 connects to platform 12 to interact with nozzle housing 14, trigger 28 and air tube 46. Trigger 28, which connects to platform 12 with trigger pin assembly 48, interacts with fluid valve 56 and air valve 64 to open fluid and air reservoirs within platform 12. Retainer 52 and stop 54 of trigger lock 32 and spacer 60 of assembly 34 limit the movement of fluid valve 56 and air valve 64 to control volumetric flows of fluid and air through gun 10. Springs 62 and 66 bias fluid valve 56 and air valve 64, respectively, to a forward or closed position. Trigger ring 68 and calibration bushing 70 of calibration mechanism 58 adjust the position at which air valve 64 engages trigger 28. Thus, using trigger lock 32 and integrated flow control assembly 34, spray gun 10 can be toggled between a locked, or no-flow, configuration and an unlocked, or flow, configuration.

Figure 3:
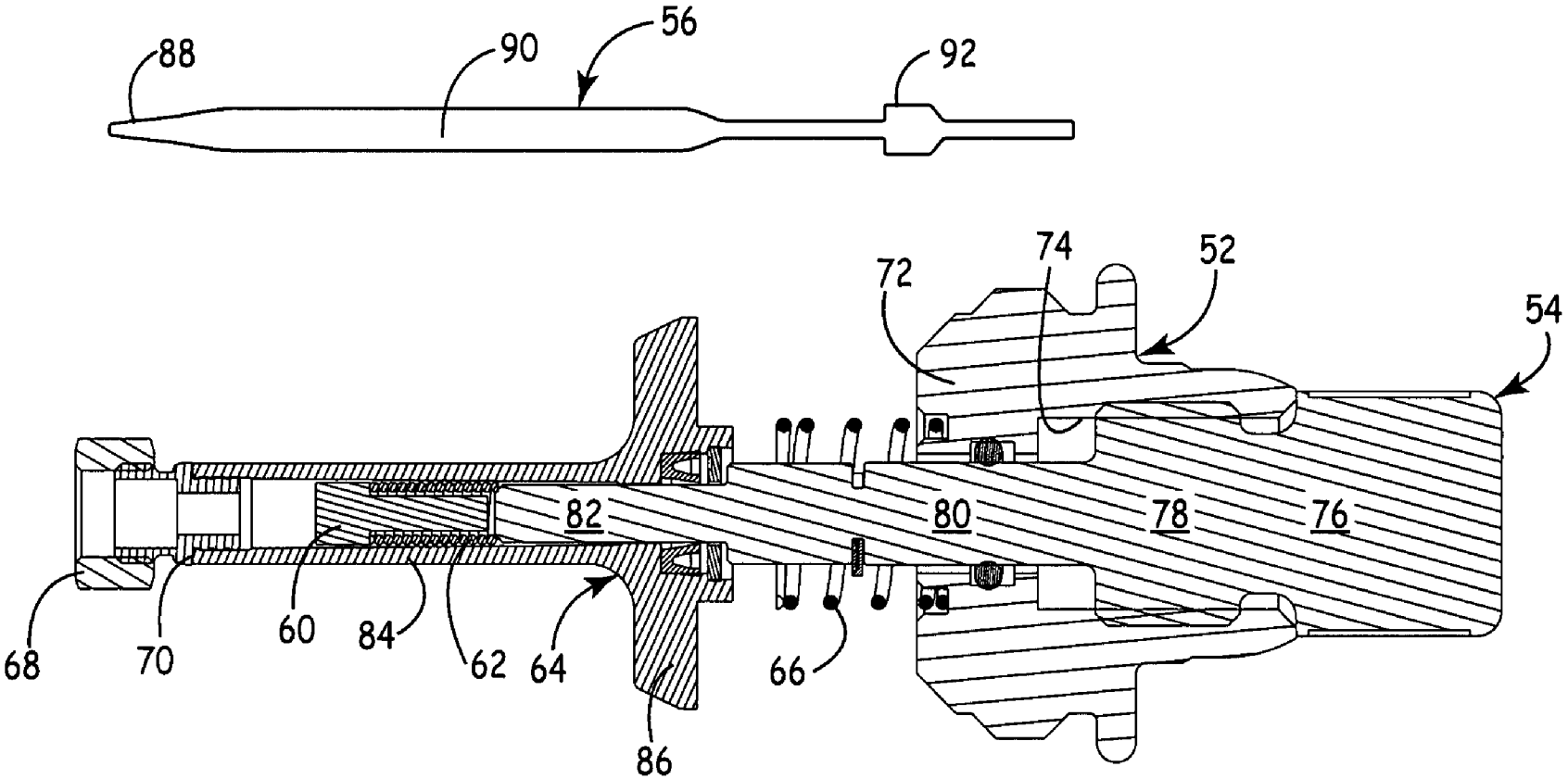
FIG. 3 shows a cross-sectional view of an assembled trigger lock and integrated flow control assembly of FIG. 2.

FIG. 3 shows a cross sectional view of trigger lock 32 assembled with integrated flow control assembly 34. Trigger lock 32 includes retainer 52 and stop 54. Integrated flow control assembly 34 includes fluid valve 56, calibration mechanism 58, spacer 60, fluid spring 62, air valve 64 and air spring 66. Calibration mechanism 58 includes trigger ring 68 and calibration bushing 70. Retainer 52 comprises an annular body having outer diameter 72 for engaging platform 12, and inner diameter bore 74 for receiving stop 54. Stop 54 includes knob 76, threaded segment 78, air stop 80 and fluid stop 82. Air valve 64 includes annular structure 84 and flange 86. Fluid valve 56 includes valve tip 88, shaft 90 and actuation flange 92.

Fluid valve 56 is inserted into air valve 64 so that actuation flange 92 is disposed concentrically with bushing 70. As such, a single stroke of trigger 28 engages both actuation flange 92 and trigger ring 68 to axially displace fluid valve 56 and air valve 64. Stop 54 restricts movement of fluid valve 56 and air valve 64 by trigger 28, while fluid spring 62 and air spring 66 bias fluid valve 56 and air valve 64 away from stop 54. Valve tip 88 and valve flange 86 are contoured to permit varying volumes of air and fluid, respectively, through gun 10. Fluid valve 56 and air valve 64 are thus co-actuated to simultaneously vary volumetric flow rates of pressurized air and pressurized fluid over a range, as is discussed in greater detail with reference to FIGS. 4-6.

Figure 4:
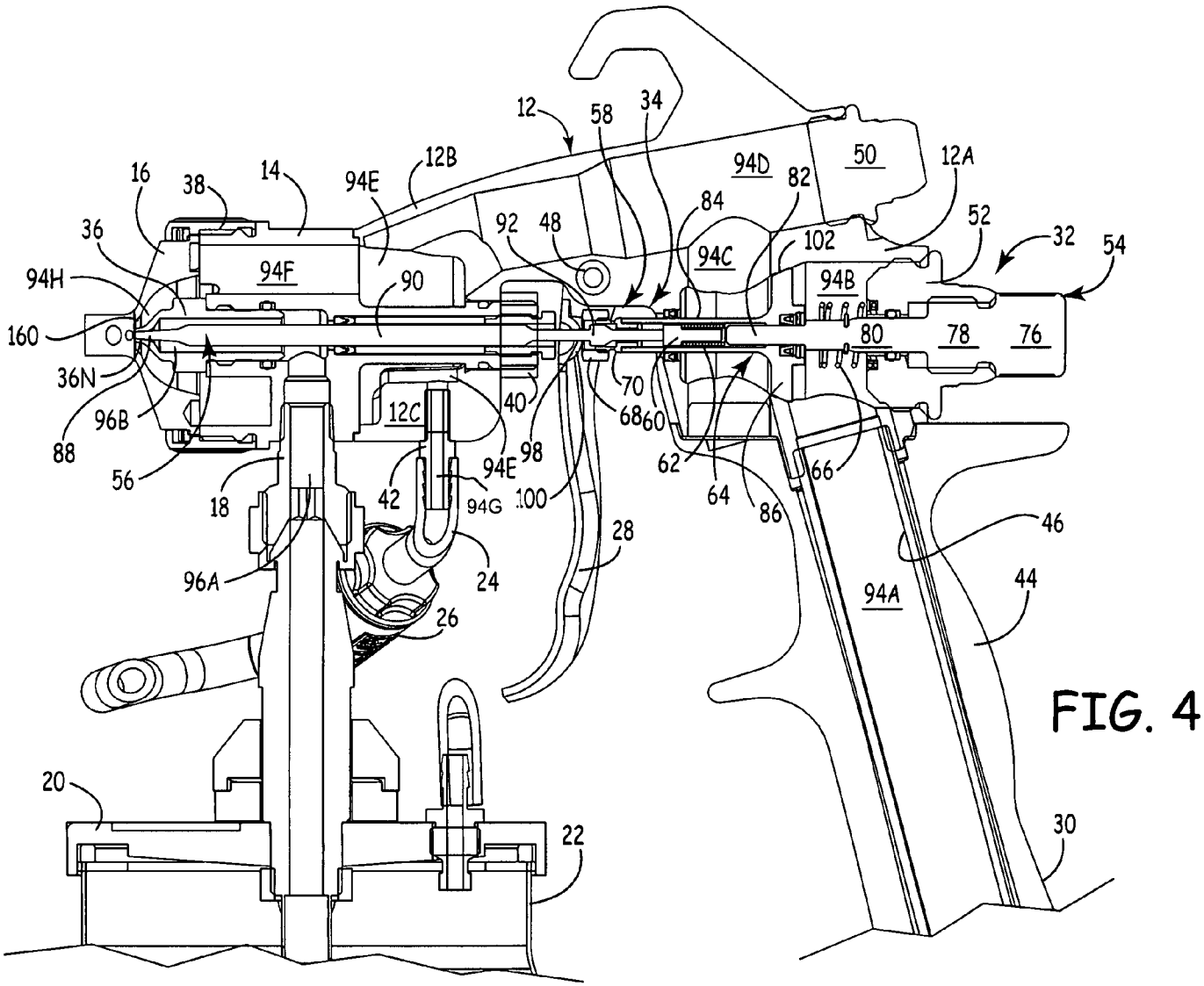
FIG. 4 shows a cross-sectional view of the air-assisted spray gun of FIG. 1 wherein an integrated flow control assembly is in a closed configuration such that air and fluid flows are inhibited.
Figure 5:
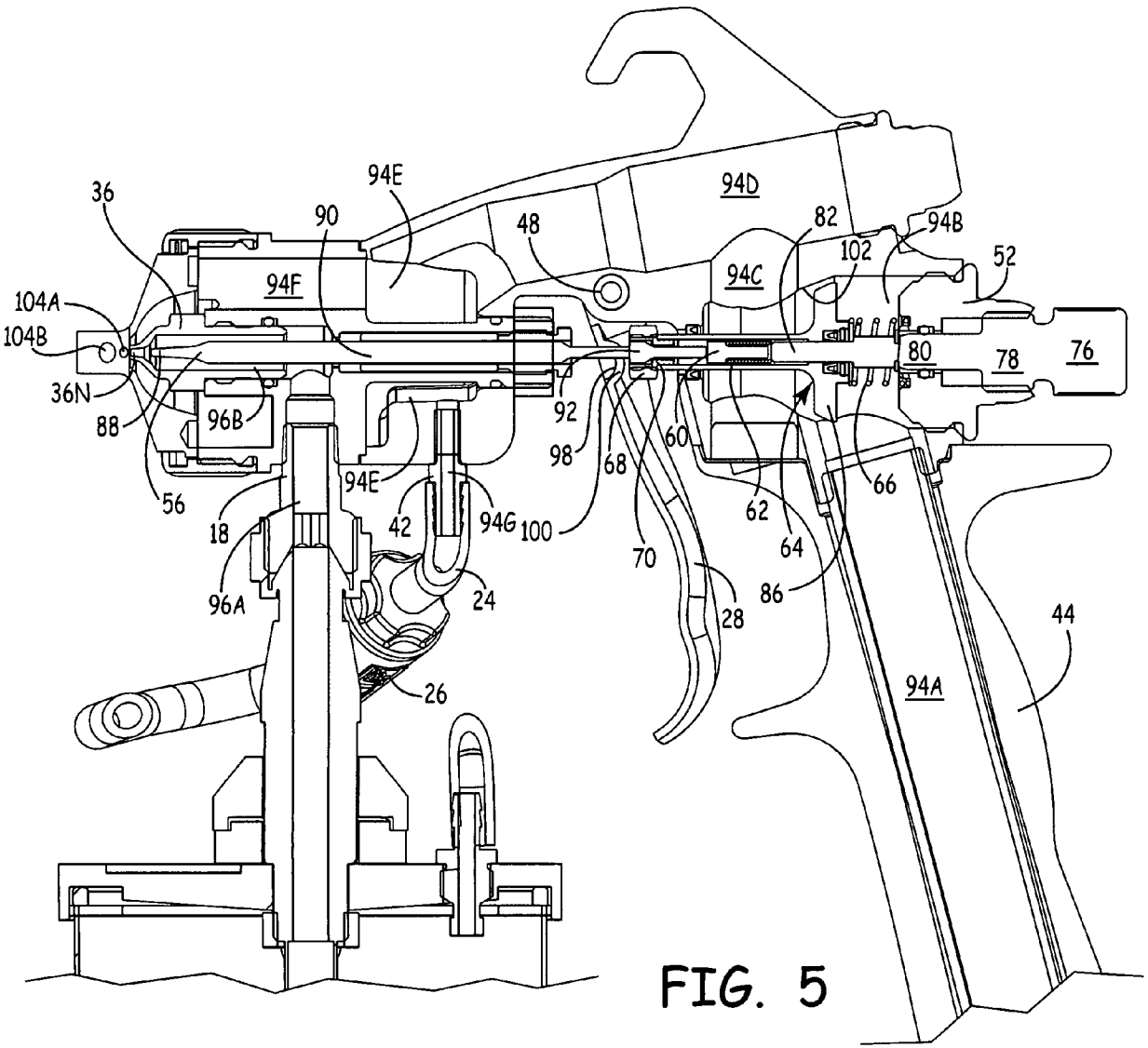
FIG. 5 shows a cross-sectional view of the air-assisted spray gun of FIG. 1 wherein an integrated flow control assembly is in an open configuration such that air and fluid flows are enabled.

FIG. 4 shows a cross section of spray gun 10 taken at section 4-4 of FIG. 1. FIG. 4 shows spray gun 10 in a no-flow configuration in which air and fluid flow through platform 12 is inhibited by integrated flow control assembly 34. FIG. 5, as discussed below, shows spray gun 10 in a flow configuration in which air and fluid flow through platform 12 is enabled by integrated flow control assembly 34.

Spray gun 10 includes platform 12, nozzle housing 14, spray cap 16, discharge orifice 160, fluid coupling 18, fluid lid assembly 20, fluid cup 22, pressure line 24, check valve 26, trigger 28, air coupling 30, lock 32, integrated flow control assembly 34, spray nozzle 36, fluid nozzle 36N, retention ring 38, retention nut 40, air stem 42, handle 44, air tube 46, trigger pin assembly 48 and air cap 50. Trigger lock 32 includes retainer 52 and stop 54. Integrated flow control assembly 34 includes fluid valve 56, calibration mechanism 58, spacer 60, fluid spring 62, air valve 64 and air spring 66. Calibration mechanism 58 includes trigger ring 68 and calibration bushing 70. Retainer 52 comprises an annular body having outer diameter 72 for engaging platform 12, and inner diameter bore 74 for receiving stop 54. Stop 54 includes knob 76, threaded segment 78, air stop 80 and fluid stop 82. Air valve 64 includes annular structure 84 and flange 86. Fluid valve 56 includes valve tip 88, shaft 90 and actuation flange 92.

Platform 12 includes three generally horizontally extending portions: air valve portion 12A, air chamber 12B and fluid valve portion 12C. Handle 44 and air tube 46 extend from air valve portion 12A, and nozzle housing 14 and air cap 16 extend from fluid valve portion 12C such that air reservoir segments 94A-94H, and fluid reservoir segments 96A-96B extend through spray gun 10. Air valve portion 12A and fluid valve portion 12C extend generally parallel to and beneath air chamber 12B such that air valve portion 12A and fluid valve portion 12C are disposed opposite each other. Trigger 28 is suspended from air chamber 12B in a core portion of platform 12 between air valve portion 12A and fluid valve portion 12C. Fluid valve 56 extends generally horizontally through fluid valve portion 12C, and air valve 64 extends generally horizontally through air valve portion 12A. Integrated flow control assembly 34 extends between fluid reservoir segment 96B and air reservoir segment 94B to engage trigger 28. Integrated flow control assembly 34 links trigger 28 to fluid valve 56 and air valve 64 within the core of platform 12 to control air flow through air reservoir segments 94A-94H and to control fluid flow through fluid reservoir segments 96A-96B. Specifically, trigger 28 can be actuated to retract fluid valve 56 and air valve 64 to open spray orifice 36 and air reservoir segment 94B, respectively.

Air coupling 30 is connected to air tube 46, which includes air reservoir segment 94A. Air tube 46 is inserted into handle 44 and connects to air reservoir segment 94B. Retainer 52 comprises an annular structure having outer diameter 72 threaded into air reservoir segment 94B of handle portion 12A, and inner diameter bore 74 for receiving stop 54. Stop 54, which includes knob 76, threaded segment 78, air stop 80 and fluid stop 82, extends into retainer 52 such that air stop 80 and fluid stop 82 also extend into air reservoir segment 94B. Threaded segment 78 of stop 54 is threaded into retainer 52 such that stop 54 and retainer 52 remain stationary with respect to platform 12 when trigger 28 is actuated. Air valve 64, which comprises annular structure 84 and flange 86, is slipped over needle stop 82 of stop 54 such that flange 86 engages air reservoir segment 94B. Annular structure 84 extends completely through air reservoir segment 94B and out of platform 12 into the core of platform 12. Spacer 60 is disposed within annular structure 84 to abut fluid stop 82 of stop 54. Needle spring 62 is disposed between spacer 60 and fluid stop 82. Calibration mechanism 58 is rigidly fixed to annular structure 84 of air valve 64 such that mechanism 58 extends outside of platform 12. Calibration mechanism 58 includes an opening to receive fluid valve 56. Fluid valve 56 is inserted into calibration mechanism 58 and annular structure 84 to engage spacer 60. Fluid valve 56 extends from calibration mechanism 58 and into the core of platform 12 where actuation flange 92 extends radially from fluid valve 56. From actuation flange 92, fluid valve 56 continues into retention nut 40 at fluid chamber 12C within platform 12. Fluid valve 56 extends into nozzle housing 14 and through fluid reservoir segment 96B to engage fluid nozzle 36N of spray nozzle 36.

Trigger 28 is pivotably suspended from trigger pin assembly 48 to extend into the core of platform 12. Trigger 28 includes bore 98 through which fluid valve 56 extends. Trigger 28 also includes shoulder 100 against which fluid valve 56 and trigger ring 68 engage to move fluid valve 56 and air valve 64 when trigger 28 is actuated. As shown in FIG. 3, however, trigger 28 is un-actuated such that air and fluid flow through gun 10 in inhibited. Air spring 66 pushes against retainer 52 to bias air valve 64 into a forward position. In the forward position, flange 86 of air valve 64 engages the interior walls of air reservoir segment 94B, which form valve seat 102, such that pressurized air is not permitted to flow into air reservoir segment 94C. Valve seat 102 is machined into air reservoir segment 94B to precisely mate with flange 86. Valve spring 66 pushes against fluid stop 82 to bias spacer 60 into a forward position. In the forward position, spacer 60 pushes valve tip 88 of fluid valve 56 into fluid nozzle 36N such that fluid from within fluid reservoir segment 96B is not permitted to flow into nozzle cap 16 and out of gun 10 at discharge orifice 160. Thus, with trigger 28 un-actuated, integrated flow control mechanism 34 prohibits flow of air and fluid through gun 10.

Trigger lock 32 can be set to prevent accidental or premature actuation of trigger 28. As shown in FIG. 4, stop 54 is threaded fully into retainer 52 such that knob 76 of stop 54 engages retainer 52. Consequently, spacer 60 rigidly pushes fluid valve 56 into fluid nozzle 36N. Thus, spacer 60 is immobilized between fluid valve 56 and fluid stop 82, and trigger 28 cannot be actuated to push fluid valve 56 back toward stop 54. Similarly, air valve 64 engages air stop 80 to immobilize air valve 64 between stop 54 and calibration mechanism 34. Trigger 28 is therefore unable to push trigger ring 68 and air valve 64 back toward retainer 52. Trigger 28 therefore cannot be actuated to enable air and fluid flow through gun 10 until stop 54 is backed out of retainer 52.

FIG. 5 shows a cross section of spray gun 10 similar to that of FIG. 4 and like components are identically numbered. FIG. 5, however, shows spray gun 10 in a flow configuration in which air and fluid flow through platform 12 is enabled by trigger lock 32 and integrated flow control assembly 34. Knob 76 is rotated to retract threaded segment 78 from retainer 52. Thus, stop 54 is backed out of retainer 52 a fixed distance that correspondingly increases the distance between air stop 80 and valve seat 102, and the distance between fluid stop 82 and spray nozzle 36. As such, the space between valve stop 82 and fluid valve 56 is increased to a distance greater than the length of spacer 60. Fluid spring 62 pushes spacer 60 away from fluid stop 82, against fluid valve 56. Likewise, air spring 66 pushes air valve 64 away from retainer 52, against trigger 28.

Thus, play is produced within integrated flow control assembly 34, the slack of which is taken up by actuation of trigger 28, and the corresponding compression of springs 62 and 66. Trigger 28 is pivoted about trigger pin assembly 48 to be brought closer to handle 44. Shoulder 100 of trigger 28 engages trigger ring 68 which, through bushing 70, pushes air valve 64 toward stop 54. Shoulder 100 also engages actuation flange 92 to push fluid valve 56 toward stop 54. Thus, valve tip 88 is pulled away from fluid nozzle 36N and valve flange 86 is pulled away from valve seat 102.

Pressurized air from air coupling 30 enters handle 44 through air reservoir segment 94A and continues into platform 12 at air reservoir segment 94B. Valve flange 86 is retracted from valve seat 102 such that the pressurized air is permitted to flow from air reservoir segment 94B into air reservoir segment 94C. Valve flange 86 and valve seat 102 are contoured to permit varying volumetric flow rates of pressurized air into air reservoir segment 94C, depending on the length over which trigger 28 is actuated. From segment 94C, the pressurized air travels through air reservoir segment 94D within air chamber 12B and into air reservoir segment 94E within fluid valve portion 12C. From segment 94E, the pressurized air is splits to flow into air cap 16 and segment 94G. From within spray cap 16, the pressurized air is discharged from gun 10 through spray orifice 160. Additionally, depending on the position of spray cap 16, air is permitted to flow out of orifices 104A and 104B to shape discharged flow emitted from gun 10. From air reservoir segment 94G, pressurized air flows through air stem 42, pressure line 24, check valve 26 and fluid cap 20 to pressurize cup 22. In one embodiment, cup 22 is pressurized to a maximum pressure of about 3 psi (~20.68 kPa), although the pressure within cup 22 slightly varies depending on the position of trigger 28. Fluid within cup 22 is thereby forced into fluid coupling 18 and into fluid reservoir segments 96A and 96B. Within fluid reservoir segment 96B, the pressurized fluid is pushed into spray nozzle 36N, depending on the length over which trigger 28 is actuated. Valve tip 88 is contoured to permit varying volumetric flow rates of pressurized fluid out of fluid nozzle 36N. From spray nozzle 36, the pressurized fluid enters spray cap 16 whereby the pressurized fluid is entrained with pressurized air from air reservoir segment 94F and discharged from gun 10.

The pressurized air atomizes the pressurized fluid into a stream of fine particles such that an even, aesthetically pleasing coat of the fluid can be applied to a desired object. The size of the particles of fluid is crucial to the appearance of the applied coating. For example, if the particles are too large, the coating will show blotches of fluid. When large volumes of fluid are desired to be sprayed by gun 10, large particles of fluid are caused by too small a volume of pressurized air. Also, too large a volume of pressurized air produces an undesirable course or rough finish. Thus, it is necessary to match the volumetric flow rate of fluid leaving spray nozzle 36N with the volumetric flow rate of air leaving discharge orifice 16O to obtain optimally sized fluid particles, which must be maintained as different volumes of fluid are desired to be discharged from gun 10. Fluid valve 56 and air valve 64 are configured to permit varying volumetric flow rates of pressurized fluid and air through gun 10 to achieve optimal fluid particle size at different volumes of fluid discharge. Fluid valve 56 and air valve 64 are connected through integrated flow control assembly 34 of the present invention such that actuation of trigger 28 displaces fluid valve 56 and air valve 64. Valve flange 86 and valve seat 102 are contoured to produce a volumetric air flow through discharge orifice 16O that is calibrated with the volumetric fluid flow through spray nozzle 36N. The specific geometries of valve tip 88 and valve flange 86 can have different configurations, but in all configurations they are paired to allow flow of varying volumes of fluid and air that produce desirably sized fluid particles. The ratio of volumetric fluid flow over volumetric air flow through discharge orifice 16O increases over the entire stroke of trigger 28. Using calibration mechanism 58, the point at which the stroke of trigger 28 actuates air valve 64 can be adjusted.

Figure 6:
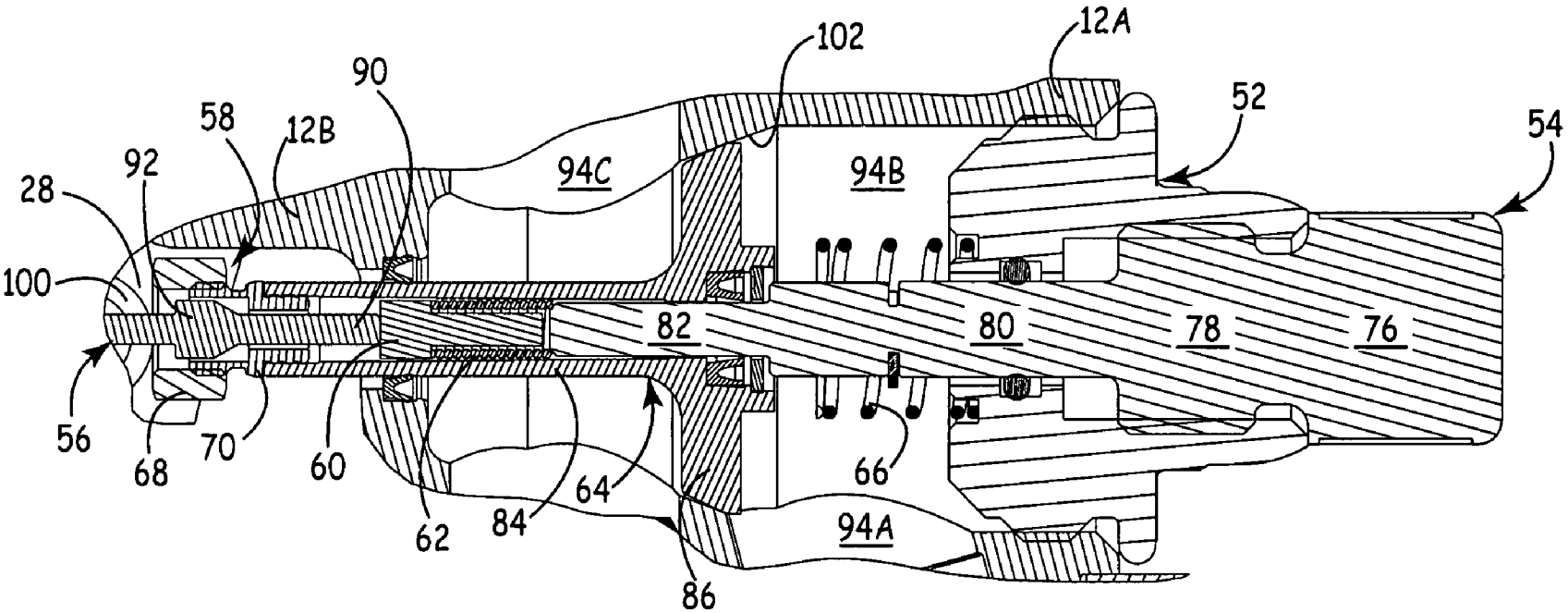
FIG. 6 shows a broken away cross-sectional view of the air-assisted spray gun of FIG. 1 showing a calibration mechanism of the integrated flow control assembly.

FIG. 6 shows a broken away cross-sectional view of air-assisted spray gun 10 of FIG. 1 showing trigger lock 32, integrated flow control assembly 34 and calibration mechanism 58. Calibration mechanism 58 includes trigger ring 68 and calibration bushing 70, which adjust the relative position of air valve 64 with respect to fluid valve 56. Calibration bushing 70 includes a first end that is threaded into annular structure 84 of air valve 64, and a second end that includes threads for engaging trigger ring 68. Calibration bushing 70 also includes a central bore for receiving shaft 90 of fluid valve 56. Trigger ring 68 comprises an annular ring, or nut, having a threaded central bore for engaging the second end of calibration bushing 70. Trigger ring 68 is adjustably positioned concentrically about bushing 70 to effectively extend the length of air valve 64.

Fluid valve 56 is inserted into calibration mechanism 58 such that actuation flange 92 is disposed generally within bushing 70. Trigger ring 68 can be disposed on bushing 70 such that trigger 28 engages ring 68 and actuation flange 92 in approximately the same position. As shown in FIG. 6, trigger ring 68 can be disposed on bushing 70 to extend ring 68 out past actuation flange 92. Thus, as trigger 28 is brought back toward handle 44, shoulder 100 of trigger 28 will engage trigger ring 68 before actuation flange 92. As trigger 28 continues through its stroke, flange 86 of air valve 64 will disengage valve seat 102 before valve tip 88 (FIGS. 4 & 5) of fluid valve 56 disengages fluid nozzle 36N. As such a volume of pre-air is discharged from discharge orifice 16O. The pre-air provides a means for cleaning spray cap 16 and spray nozzle 36. Specifically, the pre-air dislodges built-up fluid on cap 16 and nozzle 36 to prevent caking. The pre-air is automatically discharged from spray cap 16 twice every time trigger 28 is completely actuated: once before the fluid is discharged and once after the fluid is discharged. Thus, build up of fluid on nozzle 36 and spray cap 16 is prevented.

In order to accommodate the pre-air, it is also necessary to ensure that valve tip 88 disengages fluid nozzle 36N when valve flange 86 is in the same position such that the volumetric flow rates of the pressurized air and pressurized fluid within platform 12 are properly matched to atomize the discharged fluid. Calibration mechanism 58 allows integrated flow control mechanism 34 to be calibrated to account for differences in manufacturing, such as variations in tolerances of gun 10. Gun 10 is thus calibrated at the factory to ensure fluid valve 56 and air valve 64 discharge the proper ratio of fluid and air. For example, a test piece that measures volumetric flow rates can be placed over spray cap 16. Trigger ring 68 can be backed off of bushing 70 until the desired amount of pre-air is obtained at the point at which trigger 28 engages actuation flange 92 of fluid valve 56. The pre-air is determined to within +/−½ CFM.

Integrated flow control mechanism 34 of the present invention provides a user friendly valve for operating HVLP gun 10. Integrated flow control mechanism 34 enables fluid flow and air flow through gun 10 by actuation of a single mechanism. Furthermore, the volume of fluid flow and air flow is coordinated by operation of a single actuator, trigger 28. Integrated flow control mechanism matches the volumetric flow rates of the fluid and the air to produce optimally sized fluid droplets such that the most desirable finishes are achieved. For example, fluid valve 56 and air valve 64 can be paired for use with a particular source of pressurized air that provides a certain volume of compressed air. Integrated flow control mechanism also includes calibration mechanism 58 that allows the fluid flow and the air flow to be accurately matched and that permits the flow of pre-air. Thus, easy operation of HVLP gun 10 by operators of all skill levels is enabled through integrated flow control mechanism 34.

Although the present invention has been described with reference to preferred embodiments, workers skilled in the art will recognize that changes may be made in form and detail without departing from the spirit and scope of the invention.

The invention claimed is:

1. An air-assisted sprayer comprising:

a platform;

an air reservoir extending through the platform configured to receive a source of pressurized air;

a fluid reservoir extending through the platform to intersect the air reservoir, the fluid reservoir configured to receive a source of pressurized fluid;

a spray cap configured to receive pressurized air from the air reservoir and pressurized fluid from the fluid reservoir to discharge a stream of atomized fluid from the platform; and a dual flow valve positioned within the platform to intersect the air reservoir and the fluid reservoir to simultaneously vary volumetric flow rates of the pressurized air and the pressurized fluid over a range, the dual flow valve comprising:

a fluid valve linearly extending into a segment of the fluid reservoir; and an air valve engaged with the fluid valve and linearly extending into a segment of the air reservoir;

wherein the fluid valve and the air valve are co-actuated to enable flow of pressurized air and pressurized fluid through the platform; and wherein the fluid valve, the air valve, the segment of the air reservoir and the segment of the fluid reservoir are coaxial.

2. The air-assisted sprayer of claim 1 wherein the dual flow valve is calibrated such that the ratio of the volumetric flow rate of the pressurized fluid over the volumetric flow rate of the pressurized air increases over the range.

3. The air-assisted sprayer of claim 2 wherein the dual flow valve comprises a two-stage valve configured to open the air reservoir before opening the fluid reservoir.

4. The air-assisted sprayer of claim 3 wherein the pressurized fluid is pressurized by pressurized air from the air reservoir.

5. The air-assisted sprayer of claim 1 and further comprising a trigger pivotably connected to the platform and engaged with the fluid valve and the air valve, wherein actuation of the trigger linearly displaces the fluid valve and the air valve.

6. The air-assisted sprayer of claim 5 wherein the air valve includes a contoured flange portion and the air reservoir includes a corresponding valve seat, wherein the contoured portion is shaped to disengage the valve seat to permit a variable volume of air through the air reservoir.

7. The air-assisted sprayer of claim 6 wherein the air valve includes an annular shaft concentrically disposed about a portion of the fluid valve.

8. The air-assisted sprayer of claim 7 wherein the air valve includes a calibration mechanism configured to vary a position at which the trigger opens the air reservoir while maintaining fixed a position at which the trigger opens the fluid reservoir.

9. The air-assisted sprayer of claim 8 wherein the adjustment mechanism comprises:

a jack screw positioned at an end of the air valve and configured to adjust a distance between the trigger and the contoured flange portion.

10. The air-assisted sprayer of claim 9 and further comprising:

a spacer disposed within the annular shaft; and an air spring disposed within the annular shaft between the spacer and the valve stem.

11. The air-assisted sprayer of claim 10 and further comprising a trigger lock comprising:

an annular retainer connected to the platform and extending co-axially with the air valve; and a stop threaded into the annular retainer and extending into the air valve to limit axial displacement of the air valve and the fluid valve.

12. The air-assisted sprayer of claim 1 wherein the dual flow valve comprises:

a fluid valve comprising:

a tip configured to engage a fluid nozzle within the spray cap;

a shaft portion extending from the tip and extending through the fluid reservoir;

an actuation portion extending from the shaft portion and extending out of the fluid reservoir; and a flange extending radially from the actuation portion; and an air valve comprising:

an annular shaft portion extending through the air reservoir, the annular shaft portion comprising:

a threaded end extending out of the air reservoir to receive a segment of the actuation portion; and a flanged valve end having a contour configured to engage a valve seat within the air reservoir; and a jack screw engaged with the threaded end and disposed concentrically around the flange;

wherein the jack screw and the flange are configured to engage an actuation mechanism to linearly displace the fluid valve and the air valve, thereby disengaging the tip from the fluid nozzle and the contour from the valve seat.

13. An air-assisted spray gun comprising:

a platform;

a trigger pivotably mounted to the platform;

an air reservoir extending through the platform, the air reservoir comprising:

a coupling for receiving a source of pressurized air at a first end of the air reservoir; and a discharge orifice disposed at a second end of the reservoir;

a fluid reservoir extending through the platform to intersect the air reservoir, the fluid reservoir comprising:

a coupling for receiving a source of pressurized fluid at a first end of the fluid reservoir; and a fluid nozzle disposed at a second end of the fluid reservoir concentric with the discharge orifice;

a dual flow valve positioned to intersect the air reservoir and the fluid reservoir and coupled to the trigger, the dual flow valve comprising:

a fluid valve linearly extending into a segment of the fluid reservoir; and an air valve engaged with the fluid valve and linearly extending into a segment of the air reservoir;

wherein the fluid valve and the air valve are co-actuated by the trigger to enable flow of pressurized air and pressurized fluid through the platform: and a trigger lock comprising:

an annular retainer connected to the platform and extending co-axially with the air valve; and a stop threaded into the annular retainer and extending into the air valve to limit axial displacement of the air valve and the fluid valve.

14. The air-assisted spray gun of claim 13 wherein the fluid valve and the air valve are calibrated to vary volumetric flow rates of pressurized air and pressurized fluid over a range.

15. The air-assisted spray gun of claim 14 and further comprising a calibration mechanism to adjust a length of the air valve such that the trigger opens the air reservoir at a variable position and the fluid reservoir at a fixed position.

16. An air-assisted sprayer comprising:

a platform;

an air reservoir extending through the platform configured to receive a source of pressurized air;

a fluid reservoir extending through the platform to intersect the air reservoir, the fluid reservoir configured to receive a source of pressurized fluid;

a spray cap configured to receive pressurized air from the air reservoir and pressurized fluid from the fluid reservoir to discharge a stream of atomized fluid from the platform; and a dual flow valve positioned within the platform to intersect the air reservoir and the fluid reservoir to simultaneously vary volumetric flow rates of the pressurized air and the pressurized fluid over a range, the dual flow valve comprising:

a fluid valve comprising:

a tip configured to engage a fluid nozzle within the spray cap;

a shaft portion extending from the tip and extending through the fluid reservoir;

an actuation portion extending from the shaft portion and extending out of the fluid reservoir; and a flange extending radially from the actuation portion; and an air valve comprising:

an annular shaft portion extending through the air reservoir, the annular shaft portion comprising:

a threaded end extending out of the air reservoir to receive a segment of the actuation portion; and a flanged valve end having a contour configured to engage a valve seat within the air reservoir; and a jack screw engaged with the threaded end and disposed concentrically around the flange;

wherein the jack screw and the flange are configured to engage an actuation mechanism to linearly displace the fluid valve and the air valve, thereby disengaging the tip from the fluid nozzle and the contour from the valve seat.

* * * * *